United States Patent [19]

Bern et al.

[11] Patent Number: 5,005,217

[45] Date of Patent: Apr. 9, 1991

[54] NURSING BIB

[76] Inventors: Barbara J. Bern, Washington Ave., Lawrence, N.Y. 11559; Janet Y. Anderson, 205 Root Ave., Central Islip, both of N.Y. 11722

[21] Appl. No.: 493,643

[22] Filed: Mar. 15, 1990

[51] Int. Cl.[5] ..... A41D 1/20; A41D 1/22

[52] U.S. Cl. ..... 2/104; 2/48; 2/49 R

[58] Field of Search ..... 2/46, 48, 49 R, 50, 2/51, 52, 88, 104, 114, 75, 80

[56] References Cited

U.S. PATENT DOCUMENTS

| | | | |
|---|---|---|---|
| 424,344 | 3/1890 | Orr | 2/46 X |
| 1,309,269 | 7/1919 | Winnegrad | 2/104 |
| 1,354,352 | 9/1920 | Stookey | 2/51 |
| 1,979,879 | 11/1934 | Harris | 2/48 |
| 2,244,656 | 6/1941 | Asch | 2/49 R |
| 2,282,183 | 5/1942 | Harris | 2/50 |
| 2,425,402 | 8/1947 | Sieloff | 2/75 |
| 2,879,514 | 3/1939 | Shapiro . | |
| 3,629,865 | 12/1971 | Weiner . | |
| 3,984,876 | 10/1976 | Sulton | 2/48 |
| 4,031,566 | 6/1977 | Johnson | 2/104 |
| 4,266,299 | 5/1981 | Beal | 2/46 |
| 4,330,888 | 5/1982 | Klepfer | 2/48 |
| 4,458,365 | 7/1984 | Wood | 2/104 |
| 4,475,250 | 10/1984 | Savin et al. | 2/49 R |
| 4,567,611 | 2/1986 | Kendrick | 2/104 |
| 4,685,154 | 8/1987 | Smith . | |
| 4,873,725 | 10/1989 | Mitchell | 2/48 |

FOREIGN PATENT DOCUMENTS

| | | | |
|---|---|---|---|
| 382129 | 1/1908 | France | 2/75 |
| 4974 | 4/1892 | United Kingdom | 2/80 |
| 2189979 | 11/1987 | United Kingdom | 2/48 |

*Primary Examiner*—Werner H. Schroeder
*Assistant Examiner*—Jeanette E. Chapman
*Attorney, Agent, or Firm*—Leonard Belkin

[57] ABSTRACT

A protective garment for use by a person holding an infant comprising a back portion which is of waist length to permit the person to sit comfortably. The garment has a front portion of thigh length to protect the clothing of the person against being soiled by any spitting up of the infant. The two portions are joined along one vertical edge each so that the front portion can be wrapped around the front of the person. The front portion has a flap which goes over the opposite shoulder of the person and uses a Velcro type connection to hold it in place. Short puffy sleeves are employed at the ends of the shoulders to provide support for the head of the infant.

5 Claims, 2 Drawing Sheets

NURSING BIB

BACKGROUND OF THE INVENTION

The present invention relates to an adult garment to be worn by a person handling an infant and more particularly to a garment especially useful in the feeding of an infant.

It is well known that during the course of feeding, especially bottle feeding, of an infant, the person handling the infant will receive the consequences of spitting up by the infant.

To avoid the effects of such incidents which are quite normal, the person handling the infant will customarily use a towel, or a diaper, or even a bib or apron of some type to prevent soiling of the clothes.

Unfortunately, this does not provide complete protection to the individual and the adult's clothing will become soiled.

On occasion, this may happen when the parents, are dressed in fine clothes in preparation for "going out" and the infant requires immediate attention. The usual means, described above, for offering protection against soiling will not be satisfactory.

This problem has been addressed in a number of United States patents.

U.S. Pat. No 1,979,879 shows a combined apron and toilet case with front and back panels, and includes pockets.

U.S. Pat. No. 2,879,514 discloses an apron having a front panel with a skirt covering wrapped around the wearer and a neck piece fastened to the front panel.

U.S. Pat. No. 3,629,865 illustrates a baby towel with a drying portion placed against the chest of the wearer and a second drying portion placed behind the neck.

U.S. Pat. No. 3,984,876 discloses an article of clothing with a removable protective member.

U.S. Pat. No. 4,685,154 shows an apron having front and back panels connected to each other by shoulder straps.

None of the preceding patents teaches the present invention.

SUMMARY OF THE INVENTION

In this invention the problems noted above are overcome or substantially alleviated by providing a protective garment which will not only fully protect the clothing of the person carrying the infant but in addition increase the comfort of the infant who may be feeling uncomfortable as evidenced by the typical spitting up which takes place.

A preferred embodiment of this invention consists of a garment which provides coverage completely around the wearer up through the neck while at the same time is convenient and easy to use, even at the spur of the moment. The garment includes a special sleeve design which improves the comfort level of the infant whose head may be resting on or adjacent the head of the wearer of the garment. Also, provision is included to permit the wearer to keep handy any accessories the infant might need, such as the bottle, a pacifier, and the like. Other features of this invention render the garment extremely comfortable and easy to use. In addition, the garment may be designed to be disposable.

It is thus a principal object of this invention to provide a fully protective garment for an adult to be used when holding an infant.

Other objects and advantages of this invention will hereinafter become obvious from the following description of a preferred embodiment of this invention.

DESCRIPTION OF THE PREFERRED EMBODIMENT

Figure 1:
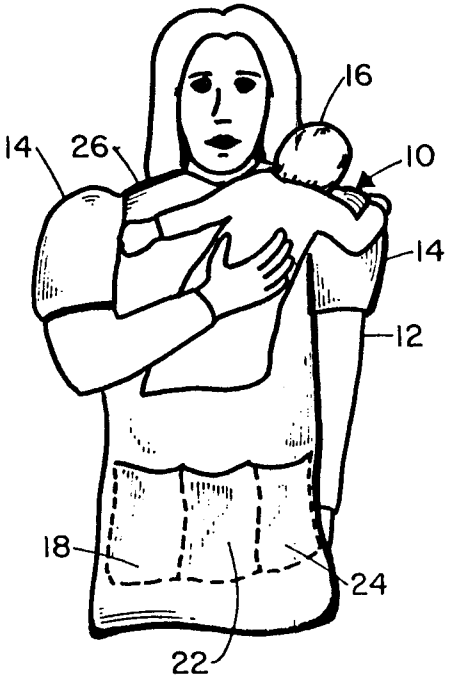
FIG. 1 is a perspective view of a person wearing a garment which is a preferred embodiment of this invention, holding an infant.

As shown in FIG. 1, garment 10 covers the upper portion of the body of wearer 12 from her thighs in the front up to the neck. Garment 10 is provided with puffy sleeves 14 to prevent the head of infant 16 from rolling off the shoulder of wearer 12 and also provide extra cushioning. It will also be noted that three pockets 18, 22, and 24 are provided so that wearer 12 will have places to carry one or more bottles, pacifier, etc.

Figure 2:
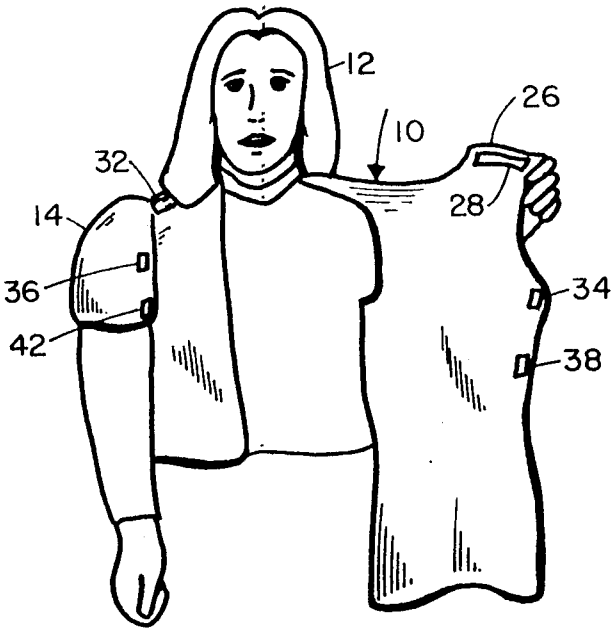
FIG. 2 is a perspective view of the wearer with the garment open in the front.
Figure 3:
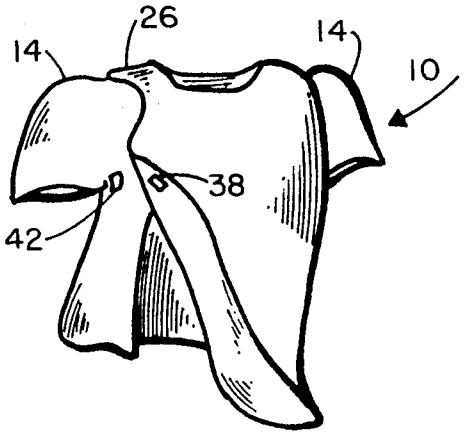
FIG. 3 is a perspective view of the garment partially closed.
Figure 4:
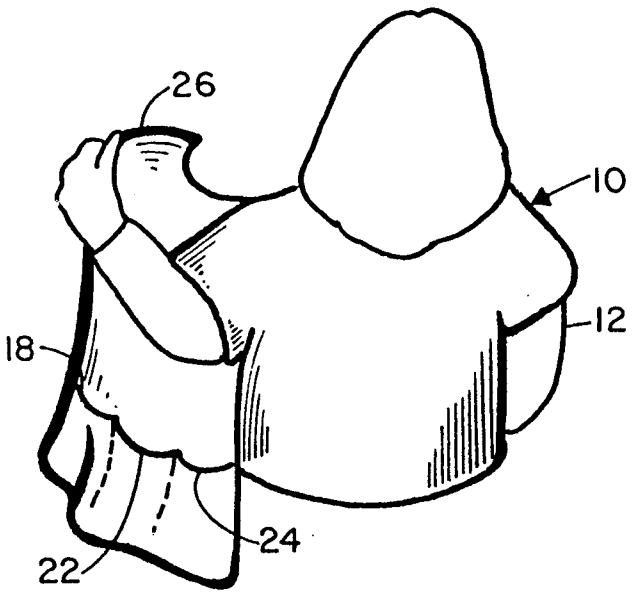
FIG. 4 is a perspective view of the rear of the wearer with the garment partially open.

As seen more particularly in FIGS. 2–4, garment 10 is at waist length in the rear making it more convenient for wearer 12 to sit without sacrificing clothing protection in the front where garment 10 drops to thigh height or lower.

Figure 5:
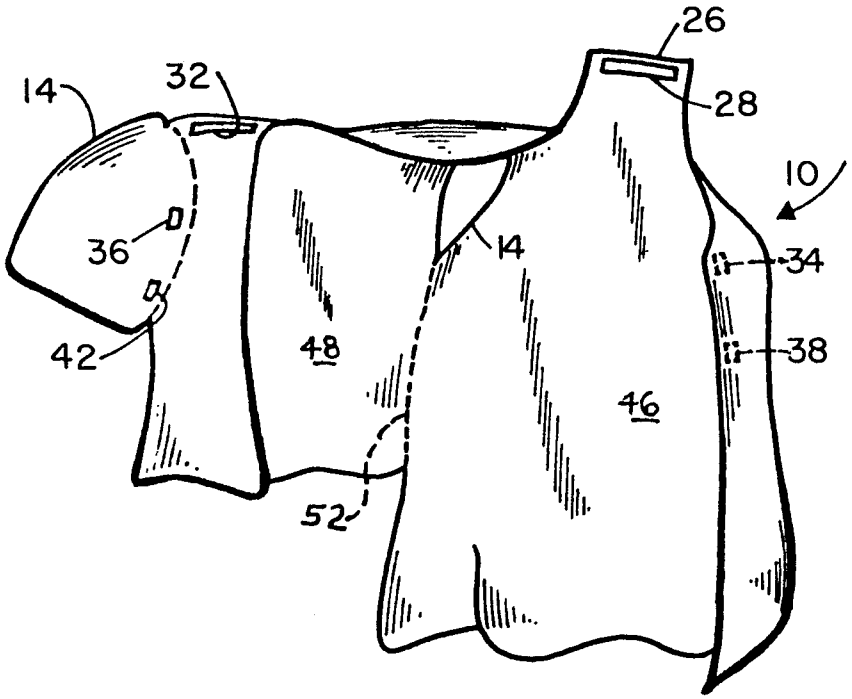
FIG. 5 is a perspective view of the garment spread open.

The open front end of garment 10 is provided with a flap-like extension 26 which overlaps the opposite shoulder of the garment permitting the use of Velcro or press type fittings 28 and 32 for convenient attachment and removal. Other Velcro or press type fittings 34, 36 and 38, 42 are employed at convenient points along the front of the garment as seen in FIGS. 2 and 5. As noted in FIG. 2, fittings 36 and 42 are located on sleeve 14 to insure that there is sufficient overlay to prevent any mess being formed between the overlapping portions of the garment.

Garment 10 is made from only four pieces of material, a front panel 46, a shortened rear panel 48, and the two sleeves 14. Shortened rear panel 48 is joined to front panel 46 along a common vertical edge 52 as shown in FIG. 5. A disposable version would probably be made from a treated paper. The non-disposable version could be made from a fleece with nylon backing. All versions would use a waterproof material.

In the arrangement just described, it is seen that garment 10 is readily slipped on, covering completely the areas where clothing can be soiled. The shortened back permits the wearer to sit without pulling on the garment. The simple arrangement for closing the front using Velcro or press type fasteners makes it possible to close the garment with one hand. Puffy sleeves 14 which are raised at the ends of the shoulders insure that the head of the infant will be cradled and prevented from rolling off the shoulder of the wearer. The pockets permit accessories such as bottles, extra diapers, pacifiers, etc., to be carried conveniently within reach.

While only a certain preferred embodiment of this invention has been described it is understood that many variations are possible without departing from the principles of this invention as defined in the claims which follow.

What is claimed is:

1. A protective garment for use by a wearer while holding an infant comprising a shortened rear panel extending down to the waist of the wearer and wrapped around one side of said wearer and covering one shoulder, a front panel extending down substantially below the waist of said wearer, said front panel being joined to said rear panel along a common vertical edge on the other side of said wearer, said front panel extending sufficiently, laterally, to wrap around said other side and front of said wearer and terminating at the front of said wearer with a flap overlapping said rear panel covering said one shoulder, short fluffy sleeve means formed at the outer edges of the shoulders of said garment raised to provide comfortable support and resting places for the head of said infant when being held and to prevent the head of the infant from rolling off a shoulder of said wearer, said flap and the overlapped rear panel being provided with press type connections for holding the flap in place.

2. The garment of claim 1 having pockets on the front panel of said garment.

3. The garment of claim 2 wherein the front panel extends down to the thighs of the wearer.

4. The garment of claim 3 wherein press type connections are located on a short fluffy sleeve means to prevent a mess being formed between overlapping panels of the garment.

5. The method of holding an infant and protecting the holder against spitting up from said infant comprising the steps of the holder putting on a garment which comprises a back panel extending down to the waist of the holder and wrapping around one side of said wearer covering one shoulder, a front panel extending down substantially below the waist of said holder, said front panel being joined to said back panel along the other side of said holder said front panel extending sufficiently to wrap around the other side and shoulder of said holder to terminate at the front of said holder, short fluffy sleeve means formed with raised portions at the outer edges of the shoulders of said garment, and a flap extending from the upper outer corner of said front panel for overlapping the back panel of said garment on said one shoulder of said holder, said flap and said back panel being overlapped provided with press type connection for holding the flap in place, and placing said infant on a shoulder of said holder so that the head of said infant is supported between the raised portion of a sleeve means and the head of said holder to prevent the head of said infant from rolling off the shoulder of the holder.

* * * * *